United States Patent [19]

Dolamore

[11] 4,315,586

[45] Feb. 16, 1982

[54] DOUBLE-ECCENTRIC LOCKING MEANS

[75] Inventor: Earl W. Dolamore, Agawam, Mass.

[73] Assignee: Roger L. Dalgleish, Suffield, Conn. ; a part interest

[21] Appl. No.: 137,396

[22] Filed: Apr. 4, 1980

[51] Int. Cl.[3] ..... B65H 17/26

[52] U.S. Cl. ..... 226/141; 226/158; 74/27

[58] Field of Search ..... 226/137, 139, 141, 142, 226/147, 149, 158, 167; 74/116, 117, 122, 123, 25, 27, 53, 570; 308/62; 271/25, 54, 69

[56] References Cited

U.S. PATENT DOCUMENTS

| | | | |
|---|---|---|---|
| 855,282 | 5/1907 | Clark . | |
| 1,091,855 | 3/1914 | Lynah . | |
| 2,477,587 | 8/1949 | Doutt . | |
| 2,495,885 | 1/1950 | Blume | 260/142 |
| 2,582,656 | 1/1952 | Scher | 271/69 |
| 2,635,875 | 4/1953 | Werner | 271/54 |
| 2,754,117 | 7/1956 | Ghormley | 271/25 |
| 2,834,224 | 5/1958 | Marcus | 74/571 |
| 2,860,015 | 11/1958 | Matterson | 308/62 |
| 3,073,591 | 1/1963 | Cosentino | 271/54 |
| 3,135,402 | 6/1964 | McCanse | 403/53 X |
| 3,986,713 | 10/1976 | Wirz | 271/268 |
| 4,138,904 | 2/1979 | Otsuka et al. | 74/570 |
| 4,218,004 | 8/1980 | Rouse | 226/149 |

*Primary Examiner*—Leonard D. Christian

[57] ABSTRACT

A strip-feed mechanism employing hold and feed gripper blades has a horizontal drive shaft with an adjustable eccentric assembly on it projecting from one side of a frame for easy access and adjustment. To accommodate extremely thin sheet material, the hold gripper blade is lifted from the sheet material during the forward portion of the stroke. The adjustable eccentric includes a cylindrical portion eccentrically mounted on a drive shaft and having a threaded periphery threadedly engaging an internally threaded wall of a bore through a cam member. The cam member and the threaded portion of the drive means are clamped together by a fastening means including a threaded plug and bolts. The threaded plug is threadedly received in the bore in the cam member, and the bolts are received in tapped holes in the cylindrical portion and bear against the plug to stress the mating threads on the drive member and cam member.

27 Claims, 11 Drawing Figures

DOUBLE-ECCENTRIC LOCKING MEANS

BACKGROUND OF THE INVENTION

The teachings of the present invention are particularly applicable to the art of gripper feed mechanisms. However, in its broader aspects, the present invention can be applied to any type of mechanical device in which it is desired to adjust cam- or eccentric-type devices used for timing or generating reciprocating motion.

Feeds of various sorts are used to provide an automated advancement of work material to a work station such as a punch press. One type of feed mechanism that has been used in the past for strip material is the gripper feed, which employs one or more reciprocating grippers to advance the sheet material. With advances in technology, many types of gripper-feed designs have fallen into disfavor; in addition to their speed limitations, gripper feeds have suffered from the fact that, due to the method of driving the strip-feed mechanism, access to the position where adjustment of stroke length can be performed is somewhat difficult. It is accordingly an object of the present invention to provide easy access to the point of adjustment of feed stroke.

Another shortcoming in some prior-art gripper feeds involves the elaborate mechanisms previously employed to permit adjustment of feed stroke. The reciprocating motion in the gripper-type feeder is often provided through the use of an eccentric member rotated by the main drive. In order to adjust the stroke, either the eccentricity of the eccentric member or the mechanical advantage provided by a particular link would typically have to be modified. However, at least in the case of an adjustment of eccentricity, the mechanisms that have been employed to permit the adjustment are somewhat elaborate. Accordingly, it is another object of the present invention to reduce the complexity of the adjustable eccentric mechanism. In its broader aspects, these teachings are applicable not only to the gripper-feed mechanism but also to various other types of devices in which an eccentric- or cam-type timing or drive mechanism is employed.

SUMMARY OF THE INVENTION

The foregoing and related objects are achieved in a strip-feed mechanism that includes a frame providing a feed path for strip material and a gripper mechanism slidably mounted in the frame for reciprocation along the path. The gripper mechanism grips strip material when it is reciprocated in a first direction and strip material is disposed in the path, but it permits the strip material to slip relative to it when it reciprocated in a second direction opposite the first direction. Reciprocation of the gripper mechanism in the first and second directions thereby advances the strip material in the first direction along the path. The strip-feed mechanism also includes an adjustable eccentric assembly mounted in the frame and drivingly connected to the gripper mechanism for reciprocation. The adjustable eccentric assembly includes drive means rotatable about a substantially horizontal axis and having a cylindrical portion whose cylinder axis is parallel to the axis of rotation. The cylindrical portion is externally threaded along at least a portion of its axial length. Also included is a cam member having a bore in it. The wall of the bore has an internally threaded portion threadedly engaged with the threaded portion of the cylindrical portion of the drive means. The periphery of the cam member defines a cam surface varying in radial spacing from the cylinder axis of the drive member and being operatively connected to the gripper mechanism for reciprocation upon eccentric motion of the cam surface. Finally, the adjustable eccentric assembly includes fastening means carried by one of the drive means and the cam member and clamping the drive means to the cam member to stress the threads of the engaged threaded portions. Static friction between the threads is thereby increased, which tends to prevent relative rotational motion between the drive means and the cam member. Rotation of the drive means thereby tends to cause rotation of the cam member and thereby reciprocation of the gripper mechanism when the cam surface varies in radial spacing from the rotational axis of the drive member.

The strip-feed mechanism typically includes a second gripper mechanism mounted in fixed position in the path. The second gripper mechanism is operable to grip strip material to prevent it from moving in the second direction. Preferably, the strip-feed mechanism also has means for disengaging the second gripper from the sheet material to prevent gripping while the first gripper mechanism is reciprocated in the first direction. Ordinarily, the means for disengaging the second gripper is operatively connected to the drive means for operation thereof by rotation of the drive means.

In the preferred embodiment, the gripper mechanism includes a slide table slidably mounted in the frame for reciprocation in the first and second directions. The slide table provides a table surface along which the feed path extends, and the gripper mechanism further includes a gripper blade pivotably mounted on the slide table for pivoting about an axis parallel to the table surface and perpendicular to the first and second directions. The gripper blade pivots from a rest position in which the free end of the gripper blade contacts the table surface and in which the gripper blade is inclined at an angle. From that angle, pivoting of the gripper blade in the first direction lifts the free end from the table surface, but pivoting of the gripper blade in the second direction is prevented by the table surface. The gripper blade is biased to the rest position, and reciprocation of the slide table in the second direction when the strip material is in the path thereby tends to pivot the gripper blade in the first direction to permit the strip material to slip relative to the gripper blade. Reciprocation of the strip material in the first direction when the strip material is in the path thereby tends to cause the gripper blade to grip the strip material.

The strip-feed mechanism may include rocker means mounted in the frame for pivoting about a pivot axis. The rocker means is operatively connected to the gripper mechanism for reciprocation of the gripper mechanism upon pivoting of the rocker means about the pivot axis. Cam follower means would be operatively connected to the cam member for driving by the cam surface and operatively connected to the rocker means for pivoting of the rocker means upon driving of the cam follower means by the cam surface.

In a particularly advantageous arrangement, the drive means includes an elongated drive-shaft portion rotatably mounted in the frame for rotation about the axis of rotation. The drive-shaft portion extends through one side of the frame and is adapted for being driven from the one side of the frame. The drive-shaft portion extends to a second side opposite the first side and has the cylindrical portion of the drive means on it at the second side of the frame. The frame permits access to the fastening means at the second side of the frame.

The adjustable eccentric assembly is applicable both to the strip-feed mechanism and to other devices. In one embodiment, its fastening means includes a clamp piece and at least one bolt having a head on one end and being threaded on the other end. Either the cam member or the drive means has a threaded recess receiving the threaded end of the bolt in threaded engagement with it. The bolt head bears against the clamp member to force it against the other of the cam member and the drive means. Tightening of the bolt increases the stress on the engaged threads of the internally threaded portion of the cam member and the externally threaded portion of the drive means. Loosening of the bolt tends to release the stress on the threads and permit relative rotation of the cam member and the cylindrical portion of the drive means.

In one illustrated embodiment, the cylindrical portion of the drive means has the threaded recess in it that receives the threaded end of the bolt, and the clamp portion bears against the cam member. Specifically, the clamp member includes a plug having a cylindrical portion, at least a portion of the periphery of the cylindrical portion of the plug being threaded and threadedly engaged with the internally threaded portion of the bore in the cam member. The cam member may conveniently include a knob portion adjacent the cam surface and adapted for manipulation by a human hand.

In the other illustrated embodiment, the fastening means includes a jam nut bearing against the cam member and threadedly engaging the threaded portion of the cylindrical portion of the drive means. Rotation of the jam nut relative to the drive means and the cam member in one direction tends to increase the stress on the engaged threads of the internally threaded portion in the cam member and the externally threaded portion of the drive means. Relative rotation of the jam nut relative to the drive means and the cam member in the other direction tends to relieve stress on the engaged threads on the internally threaded portion of the bore in the cam member and the externally threaded portion of the cylindrical portion of the drive means.

In both embodiments, the cylinder axis of the cylindrical portion of the drive means is spaced from the axis of rotation, and the cam surface is cylindrical.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
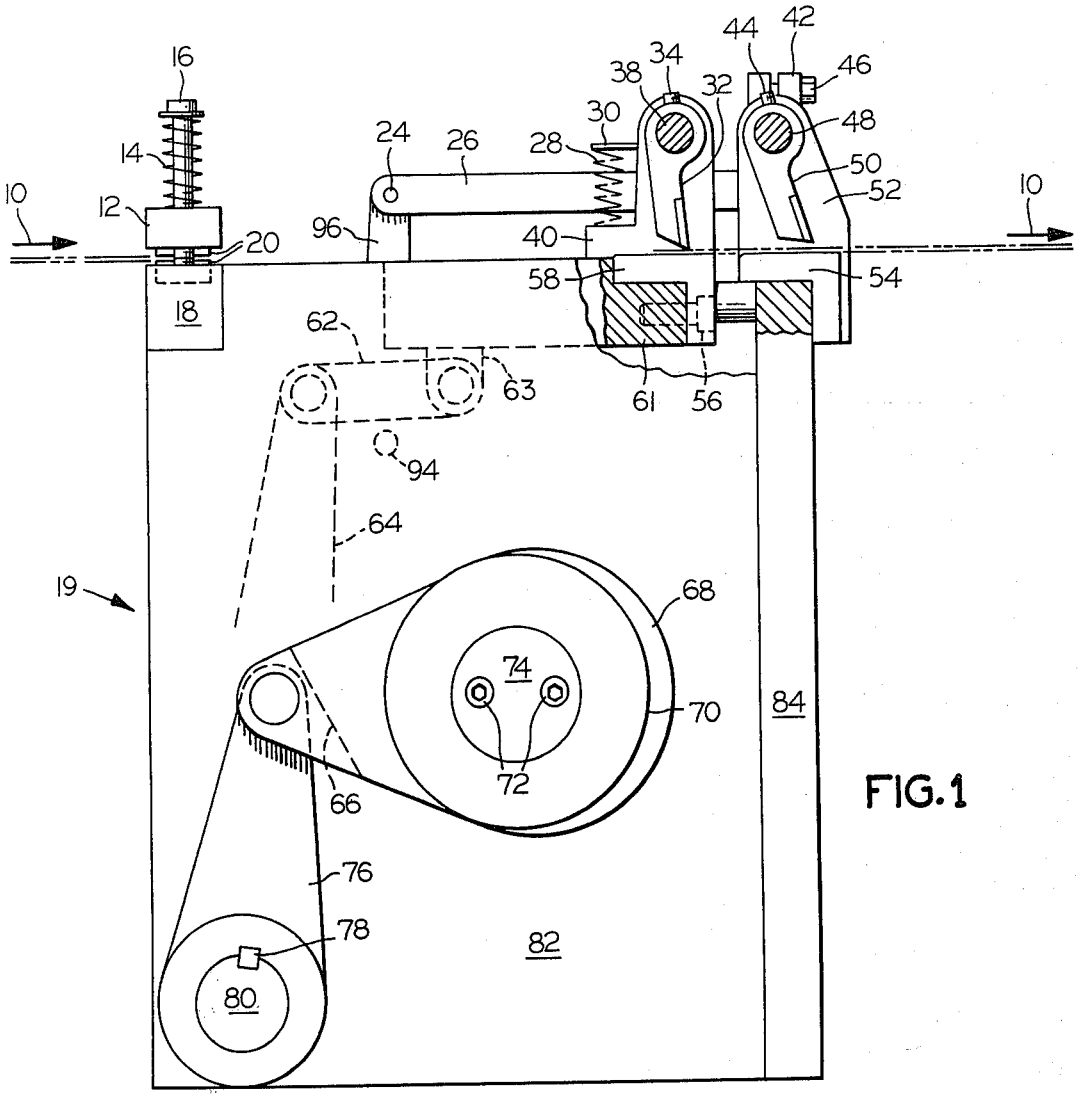
FIG. 1 is a side elevation, partially broken away, of a strip-feed mechanism employing the teachings of the present invention.

The drawings illustrate a strip-feed mechanism in which an eccentric mechanism, represented in FIG. 1 by its knob 70 and its plug 74 drives a rocker mechanism, represented in FIG. 1 by elements 64, 76, and 80, to reciprocate a slide table 61 carrying a feed gripper blade 32. Blade 32 grips sheet material disposed in a path designated by arrows 10 when table 61 is moved to the right but permits the sheet material to stay in position as slide table 61 moves to the left.

Figure 2:
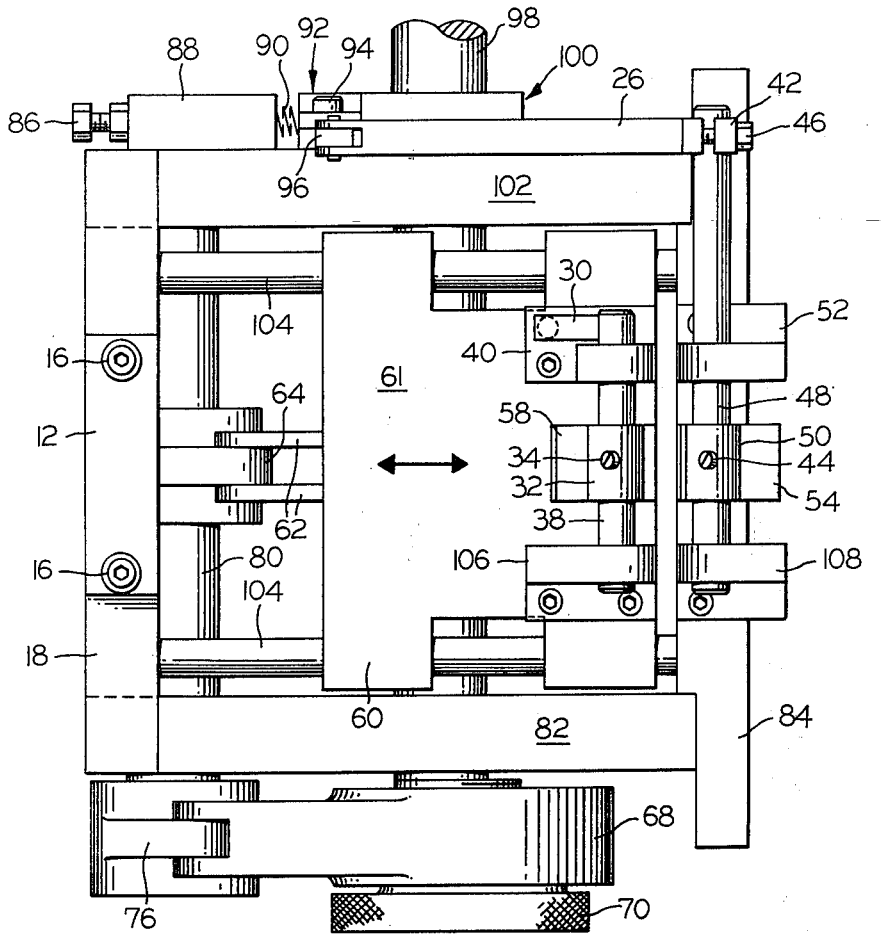
FIG. 2 is a plan view of the gripper-feed device of FIG. 1.
Figure 3:
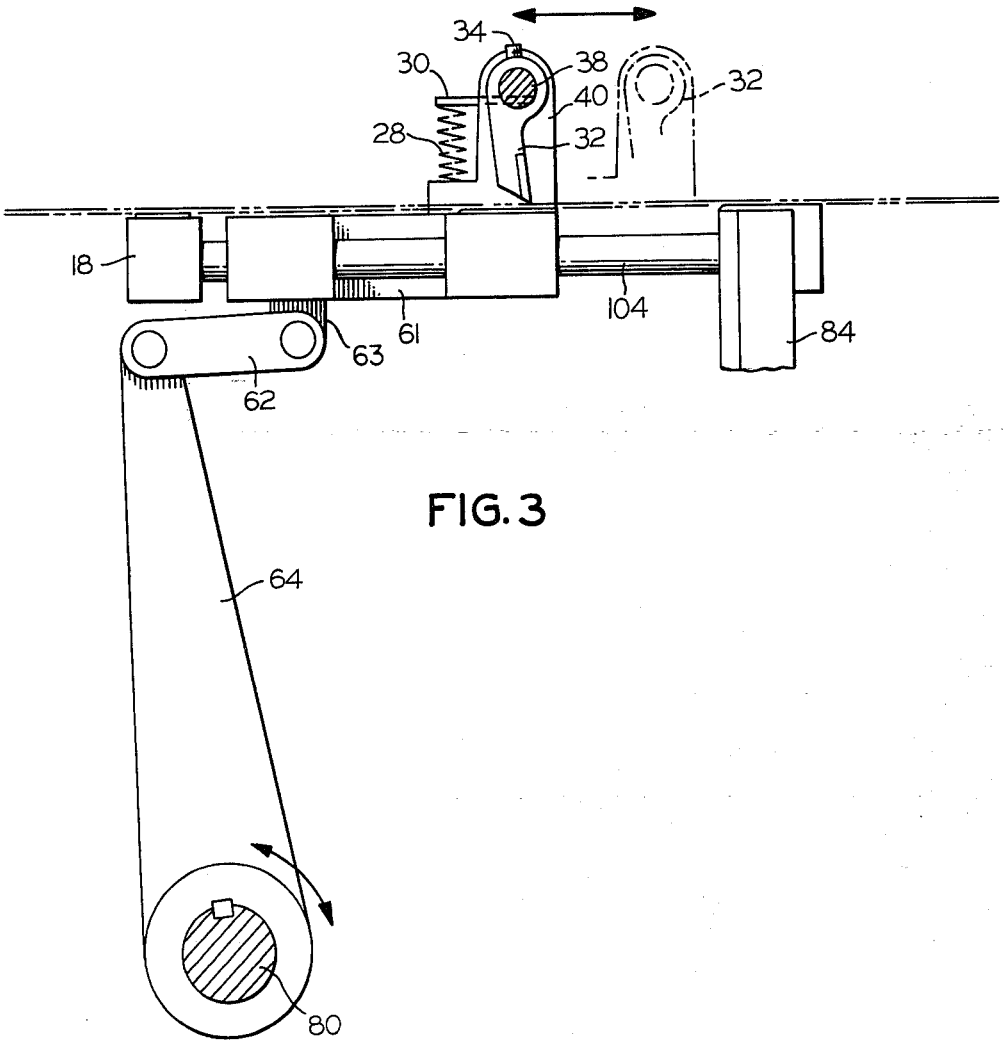
FIG. 3 is a simplified side elevation with parts removed to show the relationship of the rocker mechanism and the drive table.

Simultaneous reference to FIGS. 1, 2, and 3, discloses a device having a frame 19 that includes parallel spaced-apart side plates 82 and 102. A front plate 84 extends between corresponding edges of side plates 82 and 102 and is appropriately attached to them. A cross brace 18 extends between the other corresponding edges of side plates 82 and 102.

According to the present invention, a drive shaft 98 extends horizontally through side plates 82 and 102 and is supported by them. In the version shown in the drawings, the drive shaft 98 is integral with a part of an eccentric mechanism more fully described below that is located in FIG. 2 below side plate 82; however, drive shaft 98 could also be made removable. As a result of the horizontal orientation of drive shaft 98 and its projection through side plate 82, the eccentric mechanism is easily reached.

Figure 4:
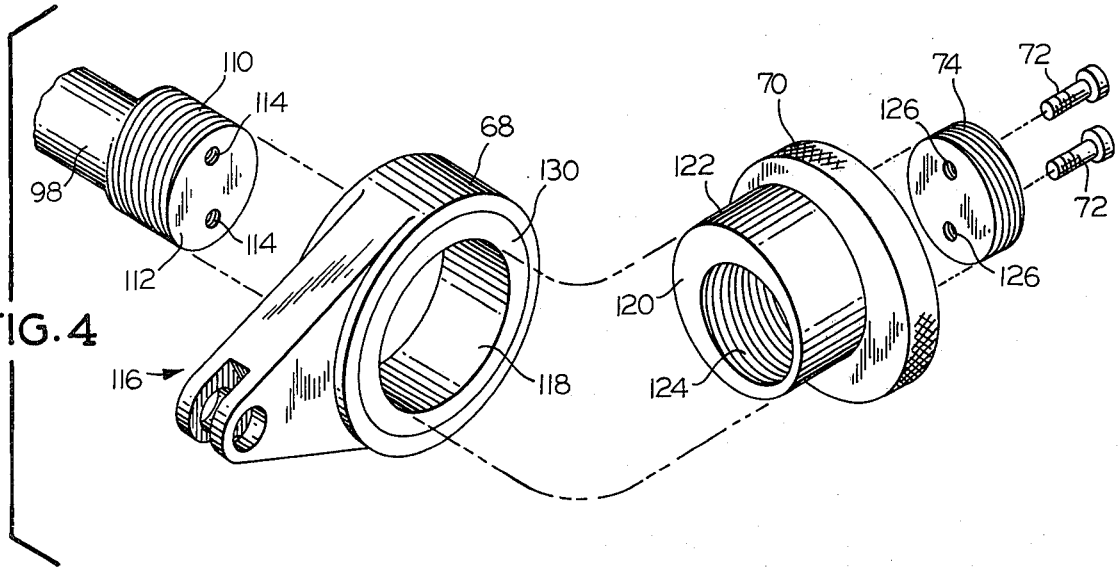
FIG. 4 is an exploded view of the eccentric mechanism employed in the strip-feed device of FIG. 1.

A connecting link 68 has a circular bore in which an eccentric surface is journaled, as is best seen in FIGS. 2 and 4 and more fully described below. Link 68 effectively acts as a cam follower to move to the left and right in FIG. 1 as shaft 98 is rotated. This motion drives a rocker link 76 pivotably connected to connecting link 68 for pivoting of rocker link 76 relative to the axis of a horizontally extending rocker shaft 80. Shaft 80 and rocker link 76 are maintained in a fixed position relative to each other by a key 78.

The rocker mechanism that includes link 76 and shaft 80 further includes a longer link 64 that is also keyed to shaft 80. Link 64 is longer than link 76 and is pivotably connected to a further link 62 pivotably connected at its other end to a mounting bracket 63 depending from a slide table 61.

Slide table 61 provides an H-shaped table surface 60 in the plane of the feed path. It is slidably mounted in the frame by means of slide shafts 104 that extend between front plate 84 and cross brace 18. Two arms of the H are slidably mounted on one of the slide shafts 104, while the other two arms are mounted on the other slide shaft. Table 61 can therefore slide back and forth along shafts 104 in response to the pivotal motion of the rocker assembly about the axis of rocker shaft 80.

Two upstanding shaft bearings 40 and 106 are suitably mounted on surface 60 of slide table 61. A gripper shaft 38 is journaled in bearings 40 and 106 for rotation about an axis parallel to table surface 60 and perpendicular to the direction of motion of the strip material. A gripper blade 32 is fastened to shaft 32 for pivoting of blade 32 with rotation of shaft 38.

Gripper blade 32 includes a generally enlarged portion that receives shaft 38 and further includes an elongated portion that extends away from shaft 38 toward the surface 60 of slide table 61. In the rest position shown in FIGS. 1 and 3, the lower edge of gripper blade 32 is in position to grip strip material lying on surface 60 of table 61. Rotation of shaft 38 in the direction counterclockwise in FIGS. 1 and 3 will cause the elongated portion of gripper blade 32 to pivot away from surface 60 and thus permit the strip material to advance relative to it without being gripped by gripper blade 32.

A pivot arm 30 is fixedly attached to a gripper-blade shaft 38 and extends rearwardly (to the left in FIG. 1) from it. A bias spring 28 is compressed between arm 30 and the surface of bearing 40 so as to bias the gripper blade 32 into the position shown in FIGS. 1 and 3.

To the right of the table 61 in FIGS. 1 and 2 is mounted an L-shaped anvil 58 secured to table 61 by an appropriate bolt 56. Anvil 58 provides the surface on the table against which gripper blade 32 grips the strip material.

A second pair of shaft bearings 52 and 108 are mounted on the upper end of front plate 84. A second gripper shaft 48 is journaled in bearings 52 and 108 to extend parallel to shaft 38. A hold gripper 50 similar in shape to feed gripper blade 32 is mounted to shaft 48 for pivotal motion upon rotation of shaft 48. Hold gripper blade 50 is held in position on shaft 48 by an appropriate set screw 44. An L-shaped anvil 54 is provided on the upper edge of front plate 84 for coopration with hold gripper blade 50.

On cross brace 18 is mounted a brake clamp 12 by means of two upstanding bolts 16 that extend into brace 18. Brake clamp 12 is slidably mounted on bolts 16 but is biased downwardly by springs 14 compressed between clamp 12 and the upper end of bolts 14. Complementary brake shoes 20 are provided in opposed relationship on the brake clamp 12 and on cross brace 18. Brake shoes 20 provide resistance that prevents the sheet material from floating during those portions in the cycle during which the gripper blades are disengaged from the sheet material. The brake force can be adjusted by adjusting bolts 16.

Figure 5:
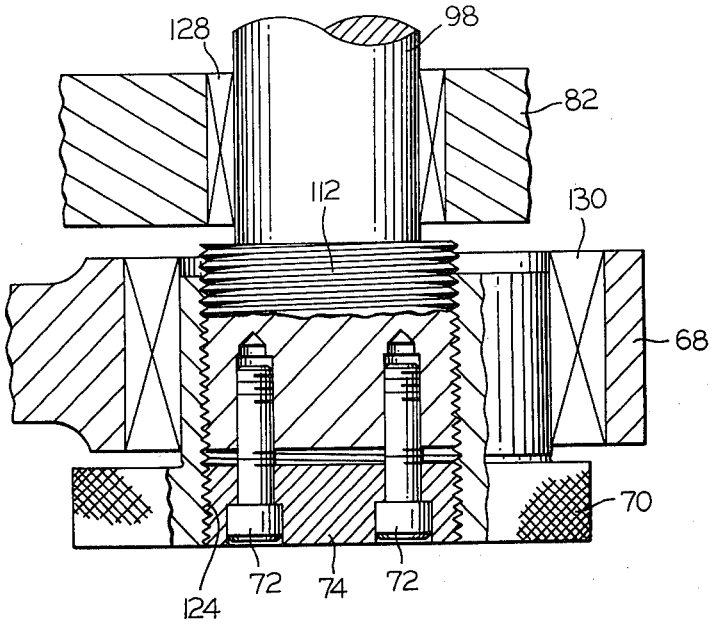
FIG. 5 is a plan view, partially in section, of the eccentric mechanism of FIG. 4.

The pivotal motion imparted to the rocker assembly originates in the rotation of drive shaft 98 and is developed by an eccentric mechanism best seen in FIGS. 4 and 5. A cylindrical portion 112 is provided at one end of drive shaft 98 and has external threads along its periphery. Cylindrical portion 112 is received in a threaded bore 124 in a cam member 120 having a cam surface 122 and a knurled knob 70. As best seen in FIG. 5, cam member 120 has internal threads extending all the way through bore 124. The external threads 110 on cylindrical portion 112 threadedly engage the interior threads in bore 124 but do not extend the entire length of the bore. A threaded plug 74 threadedly engages bore 124 from the side of cam member 120 opposite shaft 98. Plug 74 includes holes 126 therethrough that are aligned with tapped holes 114 in cylindrical portion 112 of the drive means. Bolts 72 are received in countersunk holes 126 in plug 74, and their threaded ends threadedly engage tapped holes 114. When bolts 72 are tightened, their heads bear against plug 74 to squeeze cam member 120 toward cylindrical portion 112. This results in stress on the threads in bore 124 and threaded portion 110 of cylindrical portion 112 to increase the static friction between the threads. This prevents relative rotation between cam member 120 and cylindrical portion 112 of the drive means, so plug 74 and bolts 72 act as a fastening means to clamp the two parts together. It will be noted that the stress on the threads may be relieved by loosening bolts 72, and the relative rotational position of cylindrical portion 112 and cam portion 120 can thereby be adjusted.

As is best seen in FIG. 5, shaft 98 is supported by bearing 128 in side plate 82, while bearing 130 provides the interface between connecting link 68 and shaft 120.

Figure 6:
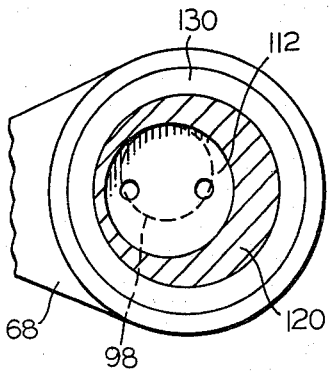
FIG. 6 is a side sectional view of the eccentric mechanism with the plug and fastening bolts removed.

The effects of varying the relative angular positions of the drive means and the cam member can be appreciated by referring to FIG. 6. Dotted lines in FIG. 6 show the position of the shaft 98, and it is seen that cylindrical portion 112 has its cylindrical axis spaced from the axis of shaft 98, which is the axis of rotation. Accordingly, cylindrical portion 12 executes eccentric motion as shaft 98 rotates.

FIG. 6 also shows that cam surface 122 has a cylinder axis that is spaced from the cylindrical axis of its central bore and thus from the cylinder axis of cylindrical portion 112. As a consequence, cam surface 122 is not concentric with cylindrical portion 112 of the drive means. In the position shown in FIG. 6, rotation of shaft 98 will result in eccentric motion of cam surface 122. However, if the relative angular positions of cam surface 122 and cylindrical portion 112 are changed, the eccentricity of the motion executed by cam surface 122 upon rotation of shaft 98 can be varied. The position shown in FIG. 6 will result in an intermediate amount of eccentricity, while a clockwise rotation of cam surface 122 through about 90° relative to cylindrical portion 112 will result in maximum eccentricity. On the other hand, counterclockwise rotation of cam surface 122 relative to cylindrical portion 112 by about the same amount will result in minimum eccentricity. Indeed, if the spacing of the cylinder axis of cylindrical portion 112 from the axis of rotation is equal to the spacing of the cylinder axis of cam 120 from the cylinder axis of cylindrical portion 112, the axis of rotation can be made to coincide with the cylinder axis of cam surface 122, thereby resulting in no eccentricity.

It will be apparent to those skilled in the art in light of this teaching that its broad application extends not only beyond the field of strip-feed mechanisms but is also applicable to devices in which one or the other of the members is not eccentrically positioned. For instance, if the cylinder axis of cylindrical portion 112 were not only parallel to the axis of rotation but also coincident with it, cylindrical portion 112 would not execute eccentric motion, although cam surface 122 would. Adjustment of the relative positions of the two members then would not vary the resultant eccentricity, but it would vary the timing of the drive. In such a device, the teachings disclosed here, namely, the fastening of the two threaded members by clamping them together to stress the threads, is equally applicable. Accordingly, this method of fastening will find a wide range of applicability.

Figure 8:
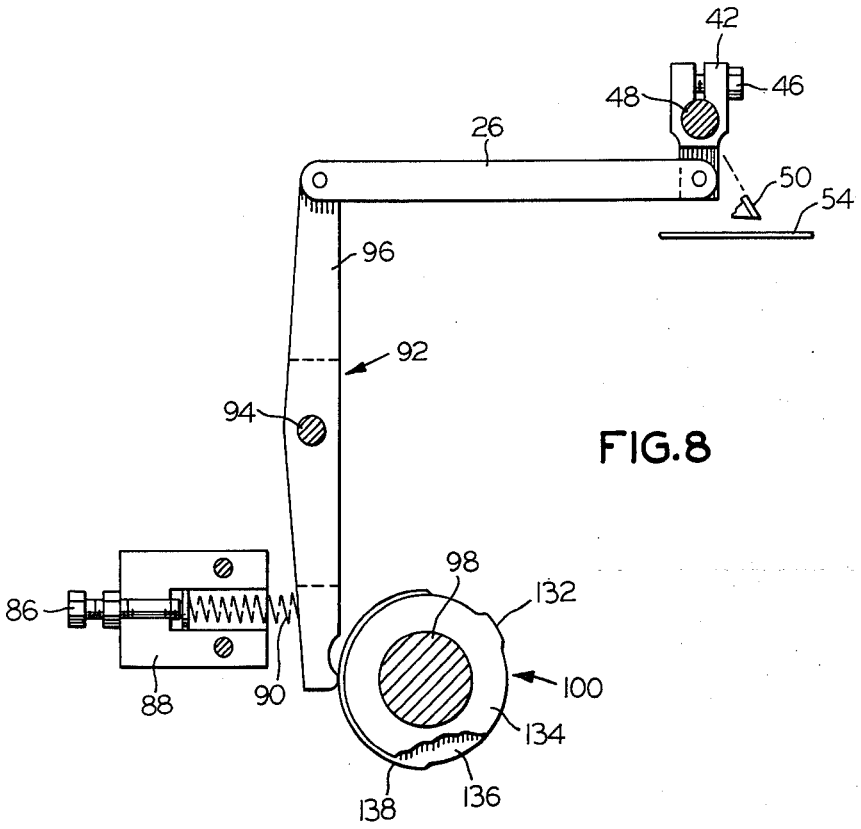
FIG. 8 is a side elevation with parts removed to show the drive mechanism for the hold gripper.
Figure 9:
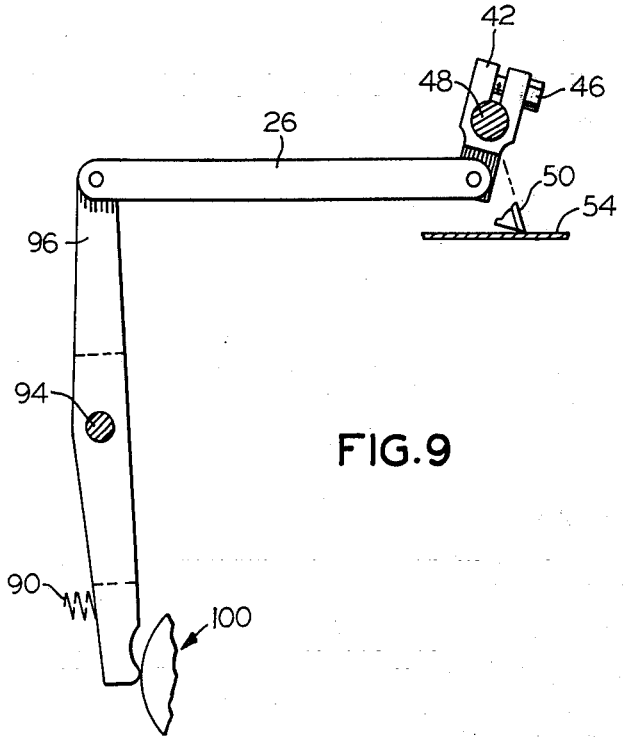
FIG. 9 is a view similar to FIG. 8 with the hold gripper in an alternate position.

As was mentioned before in connection with FIGS. 1 and 2, a hold gripper blade 50 is mounted on a shaft 48 for pivotal motion upon rotation of shaft 48. Shaft 48 is also driven by the main drive shaft 98, as is seen in FIGS. 2, 8, and 9. As FIG. 2 shows, a cam 100 is mounted on drive shaft 98 outside of side wall 102 for rotation with the drive shaft. As FIG. 8 shows, cam 100 drives a trip lever 92 that is pivotably mounted by means of pivot pin 94 on side plate 102. A connecting link 26 connects trip lever 92 to clamp 42, which is clamped to gripper shaft 48 by nut 46. As a consequence, pivotal motion of trip lever 92 will result in a rocking of clamp 42 back and forth to rotate shaft 48. This moves hold gripper blade 50 between the raised position shown in FIG. 8 and a gripping position shown in FIG. 9.

A spring cage 88 is also attached to side plate 102 and receives a bias spring 90 therein. Bias spring 90 bears against trip lever 92 to bias hold gripper blade 50 in the gripping position shown in FIG. 9. The tension on bias spring 90 may be adjusted by an adjustment screw 86.

Cam 100 actually consists of two cam members 134 and 136 that are mounted adjacent one another on drive shaft 98. Trip lever 92 varies in thickness along its length, as is suggested by the dashed lines in FIGS. 8 and 9. The bottom end of trip lever 92 is thick enough to be engaged by both cam portions. Although not shown in FIG. 8, the two cam portions are adjustably mounted so that their relative rotational positions can be varied. Cam 136 has a raised portion 138 that extends nearly 180°. This is the lift cam, and its function is to lift gripper blade 50 off the table during that portion of the cycle in which feed gripper blade 32 advances the strip material. The raising of the hold gripper blade 50 is exaggerated in FIG. 8, but some raising is necessary for particularly thin strip material; very thin strip material will buckle if hold gripper 50 is not raised.

A second cam 134 has a much shorter raised portion 132. The purpose of this raised portion is fairly conventional, its purpose being to permit piloting in a subsequent operation. The strip-feed mechanism typically feeds strip material to a subsequent machine such as a punch press, and it is important that the strip material be properly aligned during the punching operation. Accordingly, once the feed mechanism has delivered the strip material to the punch press, the strip material is aligned in pilot holes. To permit this operation, it is customary to lift hold gripper blade 50 to permit the locating of the strip material in the pilot holes.

Figure 7:
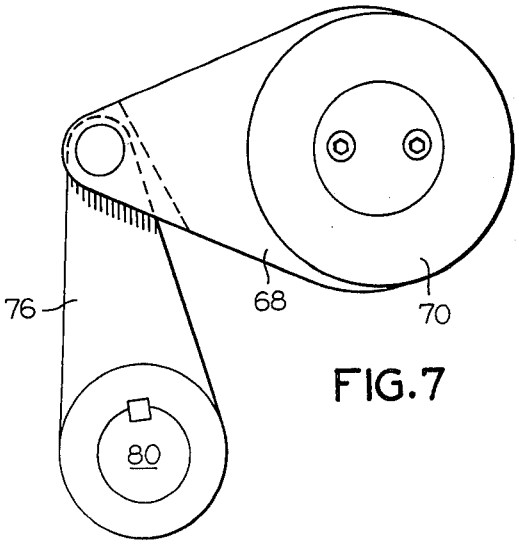
FIG. 7 is a simplified view of part of the eccentric and rocker mchanisms of the device in FIG. 1 in an alternate position.

In operation, shaft 98 is connected to an appropriate means for rotating it. For example, a gear or chain drive for transmitting rotary motion from a subsequent punch press may be provided for driving shaft 98. At the beginning of the cycle, the shaft is so positioned that the rocker mechanism takes the position shown in FIGS. 3 and 7, in which the feed gripper mechanism is in its fully retracted position. At the same time, cam 136 is in position so that raised portion 138 just begins to bear against trip lever 92. This raises hold gripper blade 50 to permit the forward feeding of the strip material. As the shaft continues to rotate, raised portion 138 continues to bear against trip lever 92 to keep hold gripper blade 50 raised from the strip material. At the same time, the eccentric motion of cam surface 122 begins to drive its cam follower, connecting link 68, to the right in FIGS. 1 and 7. This causes table 61 to move to the right, resulting in an initial tendency for gripper blade 32 to move relative to strip material disposed in path 10. However, the friction of such motion would drive gripper 32 clockwise, which would result in its tip bearing down and thus gripping sheet material with more force to prevent slippage. Consequently, the strip material is gripped by gripper blade 32 and is advanced along with it.

When slide table 61 has reached the right extremity of its cycle, cam 136 has advanced to the point where raised portion 138 no longer bears against trip lever 92. As a result, bias spring 90 acts against trip lever 92 to drive hold gripper blade 50 onto the sheet material. As shaft 98 continues to rotate, slide table 61 is caused to move to the left in FIG. 1, carrying feed gripper blade 32 with it. Frictional force between the feed material and feed gripper blade 32 now tends to cause feed gripper blade 32 to pivot in the counterclockwise direction, so that it releases the strip material. At the same time, friction against gripper blade 50 causes it to grip the strip material. Consequently, gripper blade 32 is moved to the left while the strip material remains in place.

Sometime during the rearward motion of slide table 61, machinery at the subsequent station operates to locate the strip material in pilot positions. In order to permit this, hold gripper blade 50 is lifted off the strip material 54 for a short time through the operation of raised portion 132 of cam 134. A punching operation, for example, would typically follow this positioning.

Inspection of this embodiment reveals that it has several advantages. In the first place, the driving motion is brought to the machine in rotary form, which is beneficial in the case of high-speed operation since the inertia of large reciprocating drive pieces need not be overcome. The rotary-to-reciprocal conversion occurs within the machine, and very little more than the slide table itself is moved through the complete stroke length. Accordingly, high-speed operation is facilitated. Moreover, it is easy to have the parts necessary for the stroke adjustment within in easy reach, because the shaft is horizontally disposed. Furthermore, the use of a clamping means such as plug 74 and bolts 72 for fastening the adjustable eccentric by stressing threads allows the adjustability feature to be provided with a minimum of complexity by reliable, low-maintenance parts.

Figure 10:
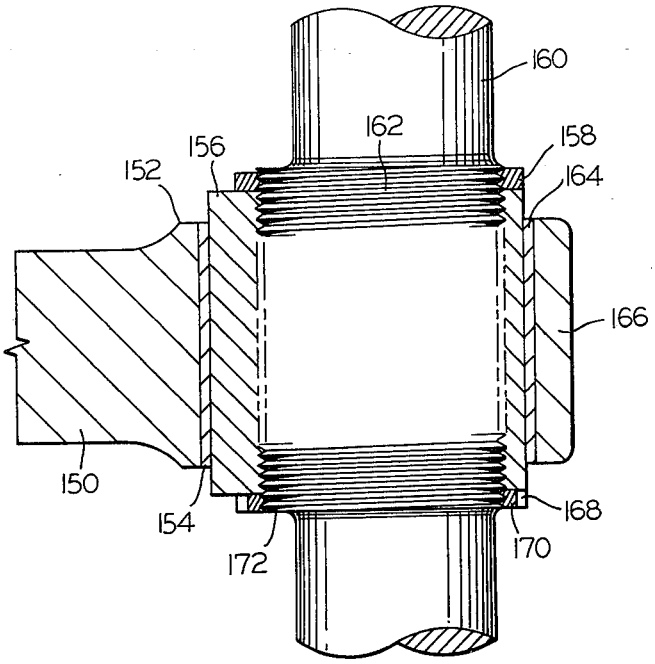
FIG. 10 is a plan view, partly in section, of an alternate arrangement of the eccentric assembly and cam follower.
Figure 11:
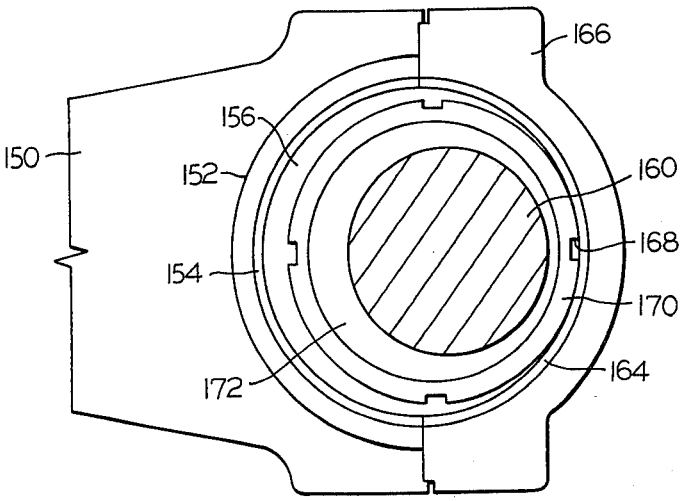
FIG. 11 is a vertical elevation, partly in section, of the alternate arrangement illustrated in FIG. 10.

An alternate arrangement of the adjustable eccentric with its fastening means is illustrated in FIGS. 10 and 11. This arrangement is particularly beneficial in those instances in which it is desirable to continue a drive shaft 160 in both directions beyond the eccentric assembly. A cylindrical portion 172 in FIGS. 10 and 11 (corresponding to cylindrical portion 112 in FIG. 4) has a threaded portion 162 that engages a threaded interior bore of a cam member 156, which corresponds to member 120 of FIG. 4. A cam follower includes two parts 150 and 166, which are appropriately joined such as by bolts (not shown). A split bearing consists of two halves 154 and 164 which are disposed between the surfaces of cam member 156 and cam-follower parts 150 and 166, respectively. Reference numeral 152 designates the edge of a semi-circular widened portion of part 150 of the cam follower.

Unlike the fastening means of FIG. 4, which includes a plug 74 received in the interior bore of cam member 120, the fastening means in the arrangement FIGS. 10 and 11 comprises a jam nut 170 that threadedly engages cylindrical portion 156 of the drive means. Jam nut 170 has appropriate slots 168 to facilitate tightening it against cam member 156 by rotating it relative to cylindrical portion 172 and cam member 156.

It will be appreciated that jam nut 170 fastens members 156 and 172 together in a manner that employs the same principle as that used by plug 74 and bolts 72; the drive means is clamped to the cam means to stress the threads of the engaged threaded portions to increase the static friction between the threads and thereby prevent relative rotation between cylindrical portion 172 and cam member 156.

In order to allow for tightening and loosening from either side, a second jam nut 158 is threadedly engaged with the threaded surface 162 of cylindrical portion 172 of the drive means, but jam nut 158 is on the side of the cam follower opposite jam nut 170. In ordinary operation, tightening of one or the other of jam nuts 158 and 170 is sufficient to fasten the adjustable eccentric assembly; in fact, it would not be desirable to tighten both jam nuts, because one nut will tend to counteract the effect of the other. Therefore, when it is desired to fasten the adjustable-eccentric assembly after it has been adjusted, one or the other jam nuts 158 and 170 is tightened, and when adjustment is again desired, the tightened nut is loosened to permit relative rotation.

It will be evident from a review of FIGS. 4, 10, and 11 that the double-eccentric assembly taught in the foregoing specification provides adjustability in a very simple and durable device. The adjustable-eccentric assembly itself is quite simple, as is the method of adjusting it. Accordingly, the adjustable-eccentric assembly taught here constitutes a significant advance in the art.

Having thus described the invention, I claim:

1. A strip-feed mechanism comprising:

a. a frame providing a feed path for strip material;

b. a gripper mechanism slidably mounted in said frame for reciprocation along said path, said gripper mechanism gripping strip material when said gripper mechanism is reciprocated in a first direction and strip material is disposed in said path, said gripper mechanism permitting the strip material to slip relative to said gripper mechanism when said gripper mechanism is reciprocated in a second direction opposite said first direction; and c. an adjustable eccentric assembly mounted in said frame and including:

(i) drive means rotatable about a substantially horizontal axis and having a cylindrical portion whose cylinder axis is parallel to said axis of rotation, said cylindrical portion being externally threaded along at least a portion of its axial length;

(ii) a cam member having a bore therein, the wall of said bore having an internally threaded portion threadedly engaged with said threaded portion of said cylindrical portion of said drive means, said cam member having its periphery defining a cam surface varying in radial spacing from said cylinder axis of said drive member and effecting reciprocation of said gripper mechanism upon eccentric motion of said cam surface; and (iii) fastening means carried by one of said drive means and said cam member and clamping said drive means to said cam member to stress the threads of said engaged threaded portions, thereby increasing the static friction between said threads and tending to prevent relative rotational motion between said drive means and said cam member, rotation of said drive means thereby tending to cause rotation of said cam member and thereby reciprocation of said gripper mechanism when said cam surface varies in radial spacing from said rotational axis of said drive member.

2. The strip-feed mechanism of claim 1 further including a second gripper mechanism mounted in fixed position in said path, said second gripper mechanism being operable to grip strip material to prevent it from moving in said second direction, said strip-feed mechanism further including means for disengaging said second gripper from the sheet material to prevent gripping thereof while said first gripper mechanism is reciprocated in said first direction.

3. A strip-feed mechanism as recited in claim 2, wherein said means for disengaging said second gripper is operated by rotation of said drive means.

4. The strip-feed mechanism of claim 1 wherein said gripper mechanism includes a slide table slidably mounted in said frame for reciprocation in said first and second directions, said slide table providing a table surface along which said feed path extends, said gripper mechanism further including a gripper blade pivotably mounted on said slide table for pivoting, about an axis parallel to said table surface and perpendicular to said first and second directions, from a rest position in which the free end of said gripper blade contacts said table surface and in which said gripper blade is inclined at an angle from which pivoting of said gripper blade in said first direction lifts said free end from said table surface but pivoting of said gripper blade in said second direction is prevented by said table surface, said gripper blade being biased to said rest position, reciprocation of said slide table in said second direction when the strip material is in said path thereby tending to pivot said gripper blade in said first direction to permit the strip material to slip relative to said gripper blade, reciprocation of said strip material in said first direction when the strip material is in said path thereby tending to cause said gripper blade to grip said strip material.

5. The strip-feed mechanism of claim 4 further including a second gripper mechanism mounted in fixed position in said path, said second gripper mechanism being operable to grip strip material to prevent it from moving in said second direction, said strip-feed mechanism further including means for disengaging said second gripper from the sheet material to prevent gripping thereof while said first gripper mechanism is reciprocated in said first direction.

6. A strip-feed mechanism as recited in claim 5 wherein said means for disengaging said second gripper is operated by rotation of said drive means.

7. The strip-feed mechanism of claim 1, 2, 3, 4, 5, or 6 further including:

a. rocker means mounted in said frame for pivoting about a pivot axis, said rocker means effecting reciprocation of said gripper mechanism upon pivoting of said rocker means about said pivot axis; and b. cam follower means engaging said cam surface and effecting pivoting of said rocker means upon driving of said cam follower means by said cam surface.

8. The strip-feed mechanism of claim 1, 2, 3, 4, 5, or 6 wherein said drive means includes an elongated drive-shaft portion rotatably mounted in said frame for rotation about said axis of rotation, extending through one side of said frame, and adapted for being driven from said one side of said frame, said drive-shaft portion extending to a second side opposite said first side and having said cylindrical portion of said drive means on said drive-shaft portion at said second side of said frame, said frame permitting access to said fastening means at said second side of said frame.

9. The strip-feed mechanism of claim 1 wherein said fastening means includes a clamp member and at least one bolt having a head on one end and being threaded on the other end, one of said cam member and said drive means having a threaded recess receiving said threaded end of said bolt in threaded engagement therewith, said bolt head bearing against said clamp member to force it against the other of said cam member and said drive means, tightening of said bolt increasing the stress on said engaged threads of said internally threaded portion of said cam member and said externally threaded portion of said drive means, loosening of said bolt tending to release the stress on said threads and permit relative rotation of said cam member and said cylindrical portion of said drive means.

10. The strip-feed mechanism of claim 9 wherein said cylindrical portion of said drive means has said threaded recess therein receiving said threaded end of said bolt and said clamp portion bears against said cam member.

11. The strip-feed mechanism of claim 10 wherein said clamp member includes a plug having a cylindrical portion, at least a portion of the periphery of said cylindrical portion of said plug being threaded and threadedly engaged with said internally threaded portion of said bore in said cam member.

12. The strip-feed mechanism of claim 11 wherein said cam member includes a knob portion adjacent said cam surface and adapted for manipulation by a human hand.

13. The strip-feed mechanism of claim 1, 9, 10, 11, or 12 wherein said cylinder axis of said cylindrical portion of said drive means is spaced from said axis of rotation thereof.

14. The strip-feed mechanism of claim 13 wherein said cam surface is cylindrical.

15. The strip-feed mechanism of claim 1 wherein said fastening means includes a jam nut bearing against said cam member and threadedly engaging said threaded portion of said cylindrical portion of said drive means, rotation of said jam nut relative to said drive means and said cam member in one direction tending to increase the stress on said engaged threads of said internally threaded portion in said cam member and said externally threaded portion of said drive means, relative rotation of said jam nut relative to said drive means and said cam member in the other direction tending to relieve stress on said engaged threads on said internally threaded portion of said bore in said cam member and said externally threaded portion of said cylindrical portion of said drive means.

16. The strip-feed mechanism of claim 15 wherein said cylinder axis of said cylindrical portion of said drive means is spaced from said axis of rotation thereof.

17. The strip-feed mechanism of claim 16 wherein said cam surface is cylindrical.

18. An adjustable eccentric assembly comprising;

a. drive means rotatable about an axis and having a cylindrical portion whose cylinder axis is parallel to said axis of rotation, said cylindrical portion being externally threaded along at least a portion of its axial length;

b. a cam member having a bore therein, the wall of said bore having an internally threaded portion threadedly engaged with said threaded portion of said cylindrical portion of said drive means, said cam member having its periphery defining a cam surface varying in radial spacing from said cylinder axis of said cylindrical portion of said drive means, and c. fastening means carried by one of said drive means and said cam member and clamping said drive means to said cam member to stress the threads of said engaged threaded portions, thereby increasing the static friction between said threads and tending to prevent relative rotational motion between said drive means and said cam member.

19. The adjustable eccentric assembly of claim 18 wherein said fastening means includes a clamp member and at least one bolt having a head on one end and being threaded on the other end, one of said cam member and said drive means having a threaded recess receiving said threaded end of said bolt in threaded engagement therewith, said bolt head bearing against said clamp member to force it against the other of said cam member and said drive means, tightening of said bolt increasing the stress on said engaged threads of said internally threaded portion of said cam member and said externally threaded portion of said drive means, loosening of said bolt tending to release the stress on said threads and permit relative rotation of said cam member and said cylindrical portion of said drive means.

20. The adjustable eccentric assembly of claim 19 wherein said cylindrical portion of said drive means has said threaded recess therein receiving said threaded end of said bolt, and said clamp portion bears against said cam member.

21. The adjustable eccentric assembly of claim 20 wherein said clamp member includes a plug having a cylindrical portion, at least a portion of the periphery of said cylindrical portion of said plug being threaded and threadedly engaged with said internally threaded portion of said bore in said cam member.

22. The adjustable eccentric assembly of claim 11 wherein said cam member includes a knob portion adjacent said cam surface and adapted for manipulation by a human hand.

23. The adjustable eccentric assembly of claim 18, 19, 20, 21, or 22 wherein said cylinder axis of said cylindrical portion of said drive means is spaced from said axis of rotation thereof.

24. The adjustable eccentric assembly of claim 23 wherein said cam surface is cylindrical.

25. The adjustable eccentric assembly of claim 18 wherein said fastening means includes a jam nut bearing against said cam member and threadedly engaging said threaded portion of said cylindrical portion of said drive means, rotation of said jam nut relative to said drive means and said cam member in one direction tending to increase the stress on said engaged threads of said internally threaded portion in said cam member and said externally threaded portion of said drive means, relative rotation of said jam nut relative to said drive means and said cam member in the other direction tending to relieve stress on said engaged threads on said internally threaded portion of said bore in said cam member and said externally threaded portion of said cylindrical portion of said drive means.

26. The adjustable eccentric assembly of claim 25 wherein said cylinder axis of said cylindrical portion of said drive means is spaced from said axis of rotation thereof.

27. The adjustable eccentric assembly of claim 26 wherein said cam surface is cylindrical.

* * * * *